United States Patent [19]

Champness

[11] 4,215,753

[45] Aug. 5, 1980

[54] DRILLING FLUID COOLING SYSTEM

[76] Inventor: Elwood Champness, 2104 Sherwood Ave., Bakersfield, Calif. 93304

[21] Appl. No.: 966,157

[22] Filed: Dec. 4, 1978

[51] Int. Cl.[2] ..... E21B 21/00

[52] U.S. Cl. ..... 175/17; 175/66; 175/208; 62/201

[58] Field of Search ..... 175/17, 66, 208; 165/60; 62/310, 201

[56] References Cited

U.S. PATENT DOCUMENTS

| | | | |
|---|---|---|---|
| 2,193,219 | 3/1940 | Bowie et al. | 175/17 |
| 2,509,031 | 5/1950 | Bockmeyer | 62/20 X |
| 3,169,575 | 2/1965 | Engalitcheff, Jr. et al. | 165/60 |
| 3,385,352 | 5/1968 | Engalitcheff, Jr. et al. | 165/60 |
| 3,777,405 | 12/1973 | Crawford | 175/66 |
| 3,780,532 | 12/1973 | Norbeck | 62/201 |
| 3,859,812 | 1/1975 | Pavlak | 62/201 |

*Primary Examiner*—William F. Pate, III
*Attorney, Agent, or Firm*—I. Michael Bak-Boychuk

[57] ABSTRACT

Disclosed herein is a transportable cooling system for cooling drilling mud in the course of drilling for geothermal sources or deep well drilling. The cooling system includes a mud carrying radiator provided with a water sprinkler assembly and fan for cooling the exterior thereof. Both the water sprinklers and the fans are controllable in their rate in response to a signal combining the well outlet temperature. In this manner cooling demands of a well bore can be anticipated, allowing for deep well drilling.

5 Claims, 3 Drawing Figures

DRILLING FLUID COOLING SYSTEM

BACKGROUND OF THE INVENTION

1. Field of the Invention

The present invention relates to well bore drilling techniques, and more particularly to techniques for cooling the drilling fluids in response to the well bore temperatures.

2. Description of the Prior Art

In the course of drilling a well by rotary methods drilling mud is quite frequently circulated through the interior of a hollow drill pipe, the drilling mud being returned at the drill bit through the annular aperture between the drill pipe and the well bore to be collected at the surface in a container or a mud pit. Heretofore direct evaporative cooling of the drilling mud has been employed as the prime means of cooling the drill tip. As the bore depths increased in the recent past and as more and more drilling has been recently directed into geothermal areas the cooling demands on the drilling fluid or mud have significantly increased. Evaporative cooling, while possible in normal applications, thus becomes less and less acceptable with increasing well bore depths, particularly where large flow rates are entailed and large amounts of chips and drilling debris are brought up to the surface. Furthermore, evaporative cooling is fixed by the temperature differential above ambient temperature and in instances where deep well bores are drilled there is often insufficient lead response to accommodate the length of time that it takes for the drilling mud to return to the surface.

SUMMARY OF THE INVENTION

Accordingly, it is the general purpose and object of the present invention to provide a transportable cooling system having variable cooling rates to accommodate various heat exchange demands entailed in well drilling.

Other objects of the invention are to provide a transportable cooling system which controls the cooling rate in response to the temperature of the well fluids as it comes to the surface, the temperature of the fluids connected for recirculation, and the temperature of the fluid cooled.

Yet additional objects of the invention are to provide a transportable cooling system adapted to be connected to various drilling sites.

Briefly, these and other objects are accomplished within the present invention by providing a radiator assembly mounted on a wheeled carriage, the radiator assembly being immersed in a spray of water and both the water spray and the radiator elements being further immersed in the air flow developed by a plurality of fans. Both the water spray and the fans are controllable in their rates by a control system which in its elements may include lead compensation to accommodate time lags entailed in transporting the well fluids to the surface. The foregoing structure may be connected to a typical prior art mud pit or container, drawing off the fluids to be cooled from the mud pit and returning the cooled fluids back into the mud pit. It is contemplated to provide a plurality of attachable sensors, one being deployed at the well casing to sense the temperature of the well fluid as it comes to the surface, the second being connected to the output conduit from the mud container to the radiator assembly and a third being connected to the radiator outlet. A combination of these temperature signals may then be used to vary the water flow rate over the radiator elements and the fan rate developing air flow thereacross.

By virtue of these functions a transportable system is provided which in its cooling features may include lead or anticipation of the down bore drilling elements.

DESCRIPTION OF THE SPECIFIC EMBODIMENT

Figure 1:
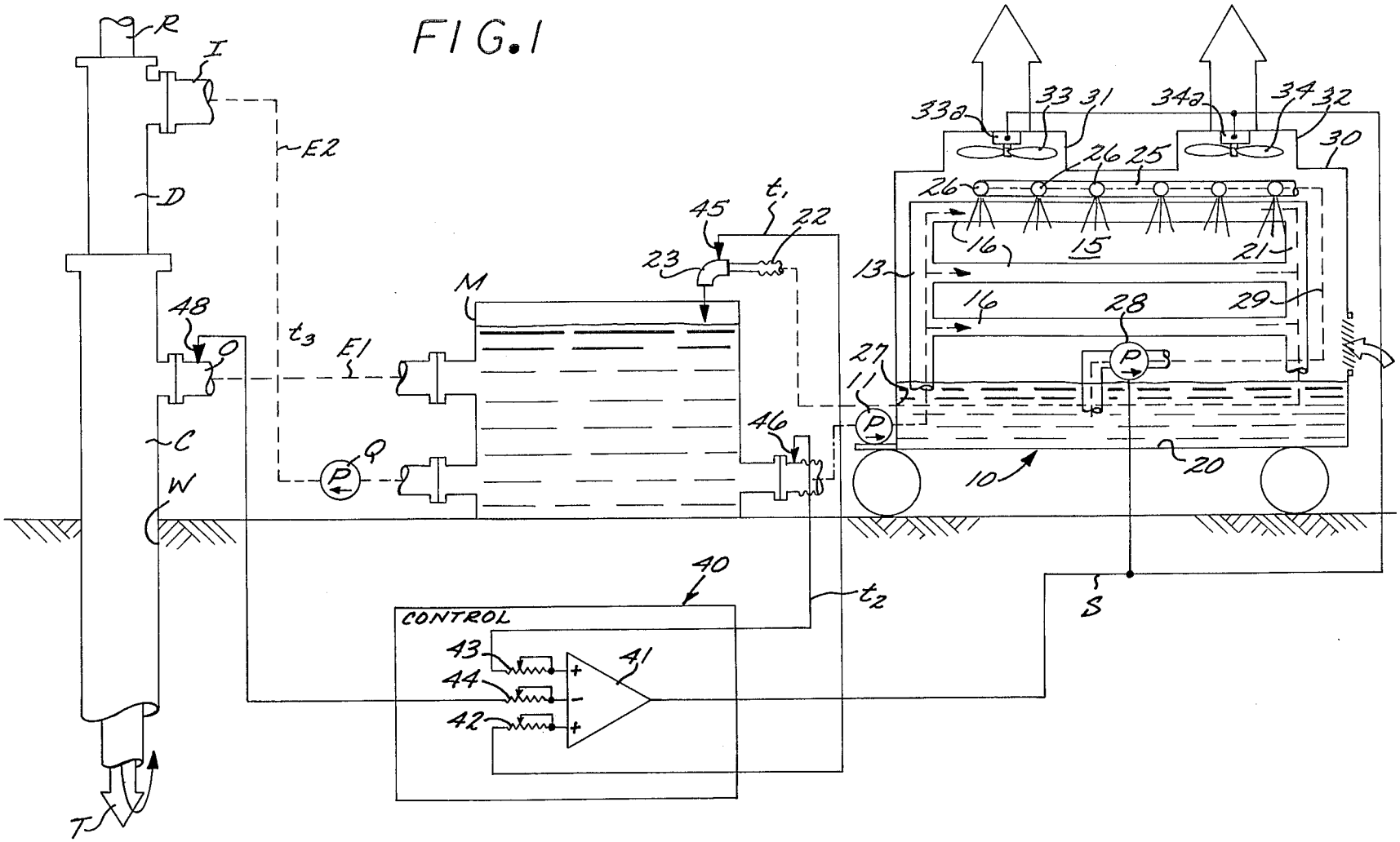
FIG. 1 is a diagrammatic illustration of a well drilling system connected for cooling to the inventive cooling system disclosed herein.
Figure 3:
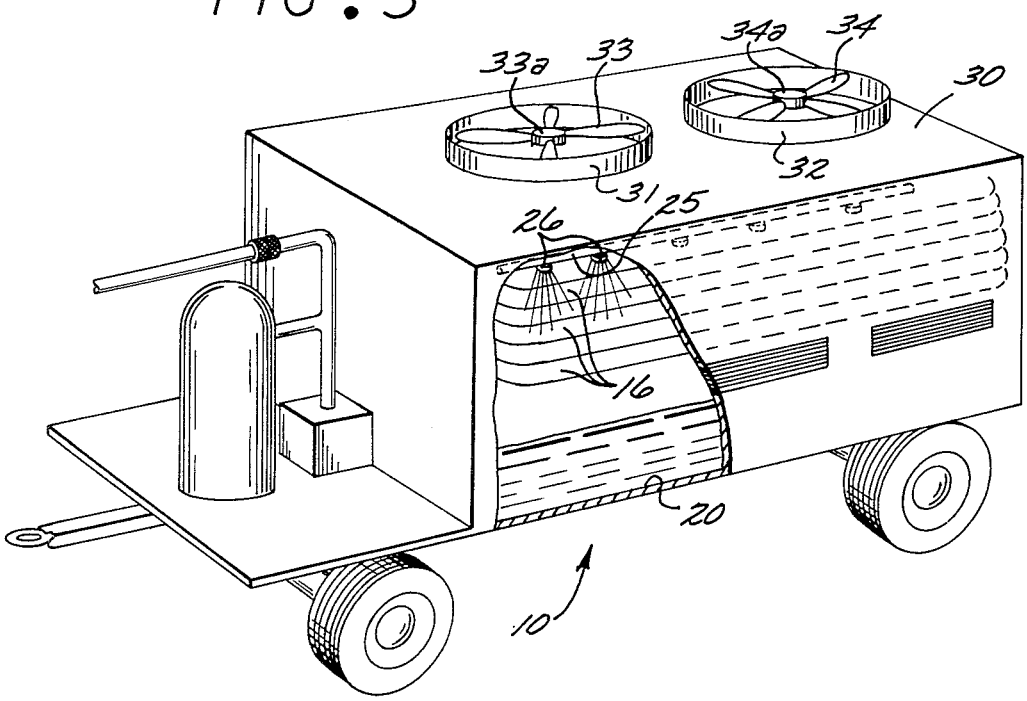
FIG. 3 is a perspective illustration of a transportable cooling assembly constructed according to the invention herein.

As shown in FIGS. 1 and 3, a typical drill site includes a well bore W provided with a casing C receiving on the interior thereof drill pipe D through which the drilling rod R extends. In this manner a folded passage is formed between the interior cavity and the drill pipe D and the rod R which turns around the bottom edge of the drill pipe proximate the drill tip T to an annular exterior passage between the drill pipe and the casing C. Most frequently the casing C is provided with an outlet O through which drilling fluids are transmitted by a conduit E1 connected to a mud container or pit M. A second conduit E2 connects between the container M and an inlet fitting I at the upper end of the drill pipe D. Conduit E2 is provided with a pump Q drawing drilling fluid from the container M into the drill pipe. This drawn drilling fluid is then passed down to the drill tip where it picks up both heat and any particulate matter developed and then is returned through the outlet O back to the container M.

Heretofore the container M provided both the function for sedimenting of the returned drilling fluid and also to cool the same fluid by evaporation. As the depth of the well bores W has recently increased the geothermal temperatures, together with the heat developed by the drill tip T, frequently reach the boiling level of the drilling fluids which quite often solidify as result of this heat input. In addition the depth of the more recent well bores dictates longer exposure time of the well fluid through the well surfaces with the result that either higher pumping rates are entailed or lower temperatures levels in the container M are necessary. Particularly when drilling for geothermal heat sources the combination of a deep well bore and high temperatures at the drill tip impose severe cooling requirements often leading to drill failure or mud solidification. For this reason it has been the customary practice to pump the drill fluid down the inner pipe thus decreasing the fluid temperature at the drill tip. While this is achieved the return trip upwards is along the exterior path in intimate contact with the thermal gradient of the surrounding earth tends to increase the average fluid temperature and the cooling demand. As the cooling demands are thus increased, the normal techniques of evaporative cooling become insufficient of entail large evaporative surfaces with the evaporative losses effecting the rate of particulate sedimentation and mud filtering techniques.

Accordingly a transportable cooling assembly, generally designated by the numeral 10 is provided including a pump 11 connected between a flexible inlet conduit 12 and a manifold 13 communicating with the elements of a radiator assembly 15. The radiator assembly 15 comprises a plurality of hollow tubular members 16 aligned horizontally above a rolling platform 20 and extending between the manifold 13 and a return manifold 21. Manifold 21, similar to the input connection, connects by way of a flexible conduit 22 to a return nozzle 23 which may be positioned over the tank M to return the chilled drilling mud. In order to improve the chilling capacity of the radiator assembly 15 there is included therein a spray head assembly 25 comprising a plurality of spray heads 26 arranged to emit a water spray impinging onto the exterior surfaces of the radiator elements 16 and dropping therefrom into a collection trough 27 supported on the rolling platform 20. Collection trough 27 includes a pump 28 having the discharge thereof connected by way of a conduit 29 to the spray head assembly 25. The wetted radiator elements are in turn housed in a fan shroud assembly 30 terminating in two upwardly directed fans ducts 31 and 32 which respectively include a corresponding fan 33 and 34. Each of the fans 33 and 34 includes a controllable fan motor 33*a* and 34*a*, motors 33*a* and 34*a* together with the pump 28 being tied to a common control signal s developed at the output of an operational amplifier 41 forming one element of a control system 40. Amplifier 41 receives across a variable input resistor 42 a temperature signal $t_1$ tied to a temperature sensor or thermocouple 45 at the outlet nozzle from the chiller assembly. Another temperature sensor 46 provides a signal $t_2$ across a variable input resistor 43 to the input of amplifier 41. Combined together with signals $t_1$ to $t_2$ is a third signal which measures the mud temperature at the well head, this signal being developed at a temperature sensor 48 developing a signal $t_3$ across a variable input resistor 44. In the foregoing arrangement signals $t_1$ and $t_2$ are arranged for subtraction, measuring the differential or the effectiveness of the chilling system. Signal $t_3$ is summed with this differential thus increasing or decreasing the differential level and the cooling demands imposed on the system. Thus the foregoing combination of signals provides the necessary thermal inputs in order to meet most of the chilling requirements in deep well drilling.

Figure 2:
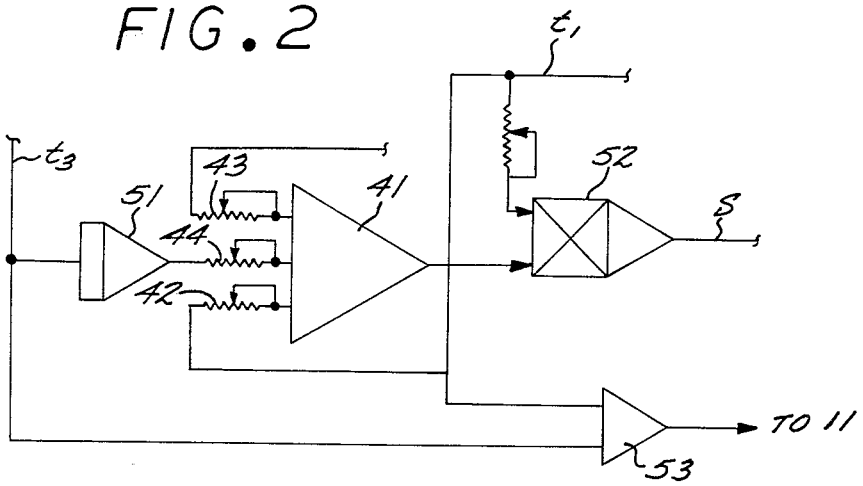
FIG. 2 is a partial diagram of an alternative control arrangement useful with the invention herein.

Should dynamic heat conditions exist in the well bore, as for example varying heat conditions occurring in the course of drilling, the foregoing control system 40 may be modified to include a lead circuit in the form of an integrate 51. The foregoing modification is shown in detail in FIG. 2. More specifically, integrator 51 will ingetrate the thermal rise occurring as result of increased well temperature level which when integrated with overtime increase the cooling demands. With appropriate selection of polarity of this integrator 51 it is now possible to provide a fully damp response from the chiller stable with the long lead term occurring in the bore. Futhermore, a multiplier 52 may be installed at the output of amplifier 41 multiplying the output by the chilled temperature signal $t_1$. This signal then serves as the above signal S while a difference between signals $t_1$ and $t_3$ may be derived at yet another operational amplifier 53 to control the rate of pump 11. In this manner full control over the downbore mud temperature can be achieved, both determined by the chilling efficiency and the total heat input in the bore. The foregoing is achieved in a transportable system which may be hooked in during the most critical drilling stages and which may serve other drilling sites during quiescent drilling states.

By virtue of the foregoing system the normally critical temperature considerations can be conveniently met and in particular temperature changes occurring during the course of drilling can be accommodated in a system which by virtue of its radiative area and chilling capacity will damp out and render stable in thermal mass problems.

Obviously many modifications and changes can be made to the foregoing description without departing from the spirit of the invention. It is therefore intended that the scope of the invention be determined solely on the claims appended hereto.

What is claimed is:

1. In a well drilling facility comprising a well bore extending into the ground and having received on the interior thereof a hollow drill pipe terminating in a drill tip, a well fluid pump for pumping well fluids down through said drill pipe towards said drill tip and for returning said fluids through the well bore to the ground surface, and a well fluid container connected to be evacuated by said well fluid pump and adapted to receive said well fluids from said well bore, the improvement comprising:

a radiator assembly including a plurality of elongate tubular members connected to communicate between an inlet manifold and an outlet manifold;

a wheeled platform attached to support said radiator assembly and including a liquid collection trough aligned subjacent said elongate members;

transfer means connected between said inlet and outlet manifolds and said container for circulating said well fluid between said radiator assembly and said container;

air cooling means deployed adjacent said elongate members for drawing air thereacross at a rate corresponding to the amplitude of a control signal;

water spray means deployed adjacent said elongate members and connected to communicate with said liquid collection trough for drawing water from said trough and ejecting said water in a spray onto the exterior surfaces of said elongate members at a rate corresponding to the amplitude of said control signal; and control means connected to sense the temperature of said well fluid for producing said control signal proportional thereto.

2. Apparatus according to claim 1 wherein:

said control means includes a first temperature sensor connected to sense the temperature of said well fluid at said well bore, a second temperature sensor for sensing the temperature of said well fluid in said container and a third temperature sensor for sensing the temperature of said well fluids in said radiator assembly, and an operational amplifier connected to said first, second and third temperature signals for producing said control signal indicative of the difference between said first and second temperature sensors.

3. Apparatus according to claim 2 wherein:

said first temperature sensor includes integrating means.

4. Apparatus according to claim 2 wherein:

said operational amplifier includes a multiplier connected to said third temperature sensor to produce said control signal indicative of the product of said difference and said third sensor.

5. Apparatus according to claim 2 wherein:

said transfer means includes a transfer pump of variable rate inversely responsive to the difference between said first and third temperature sensor.

* * * * *